US009988786B2

(12) United States Patent
Martin et al.

(10) Patent No.: US 9,988,786 B2
(45) Date of Patent: Jun. 5, 2018

(54) SKID STEER LOADER LIFT LINKAGE ASSEMBLY

(71) Applicant: DEERE & COMPANY, Moline, IL (US)

(72) Inventors: Kyle T. Martin, Asbury, IA (US); Travis Shekleton, Peosta, IA (US); Andrew W. Kahler, Dubuque, IA (US); Jeff Ekins, Mona, UT (US); Nilesh Kumbhar, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days. days.

(21) Appl. No.: 14/627,328

(22) Filed: Feb. 20, 2015

(65) Prior Publication Data

US 2015/0159342 A1 Jun. 11, 2015

Related U.S. Application Data

(62) Division of application No. 13/754,074, filed on Jan. 30, 2013, now Pat. No. 9,017,005.

(51) Int. Cl.
*E02F 3/34* (2006.01)
*E02F 3/42* (2006.01)

(52) U.S. Cl.
CPC ..... *E02F 3/422* (2013.01); *E02F 3/3405* (2013.01); *E02F 3/3414* (2013.01)

(58) Field of Classification Search
CPC ..... E02F 3/34; E02F 3/3405; E02F 3/3408; E02F 3/3411; E02F 3/3414; E02F 3/342; E02F 3/42; E02F 3/422; E02F 3/431
(Continued)

(56) References Cited

U.S. PATENT DOCUMENTS 1,371,344 A 3/1921 Brackett
2,387,656 A 10/1945 Gledhill
(Continued)

FOREIGN PATENT DOCUMENTS

EP 0628664 A2 12/1994
EP 2980320 A2 * 2/2016 ..... E02F 3/34

OTHER PUBLICATIONS

The Extended European Search Report; dated Dec. 5, 2015; 20 pages; issued by the European Patent Office.
(Continued)

*Primary Examiner* — Anna M Momper
*Assistant Examiner* — Brendan P Tighe
(74) *Attorney, Agent, or Firm* — Taft Stettinius & Hollister LLP; Stephen F. Rost

(57) ABSTRACT

A lift linkage assembly for a work machine having a work tool. The lift linkage assembly includes a frame, a boom arm, an upper link, a lower link, and a hydraulic actuator. The boom arm is configured to be pivotally coupled to the work tool and has a surface that defines a longitudinal axis. The upper link has a first end pivotally coupled to the frame and a second end pivotally coupled to the boom arm. The lower link has a first end pivotally coupled to the frame and a second end pivotally coupled to the boom arm. The hydraulic actuator has a rod that is pivotally coupled to the boom arm and moves between a retracted position and an extended position. The upper link, lower link, and hydraulic actuator are each spaced from the longitudinal axis.

15 Claims, 9 Drawing Sheets

(58) Field of Classification Search
USPC ..... 414/566, 685, 697
See application file for complete search history.

(56) References Cited

U.S. PATENT DOCUMENTS

| | | | | |
|---|---|---|---|---|
| 3,215,292 | A | 11/1965 | Halls | |
| 3,995,761 | A | 12/1976 | Hurlburt | |
| 4,218,171 | A | 8/1980 | Guinot | |
| 4,355,946 | A | 10/1982 | Wykhuis et al. | |
| 5,511,932 | A | 4/1996 | Todd et al. | |
| 5,542,814 | A | 8/1996 | Ashcroft et al. | |
| 5,918,694 | A | 7/1999 | Miller et al. | |
| 6,132,163 | A | 10/2000 | Andrews et al. | |
| 6,618,659 | B1 | 9/2003 | Berger et al. | |
| 8,152,433 | B2 * | 4/2012 | Yamada | E02F 3/3405 414/680 |
| 2006/0243234 | A1 | 11/2006 | Shibuya | |
| 2006/0245895 | A1 | 11/2006 | Horst et al. | |
| 2007/0104566 | A1 | 5/2007 | Layko et al. | |
| 2011/0217151 | A1 | 9/2011 | Major et al. | |

OTHER PUBLICATIONS

Gehl V400 Vertical Lift Skid Loader—Photos, http://gehl.com/king/Photos.htms, Feb. 19, 2013.

* cited by examiner

SKID STEER LOADER LIFT LINKAGE ASSEMBLY

RELATED APPLICATION

This application is a divisional application of U.S. patent application Ser. No. 13/754,074, filed Jan. 30, 2013, which is hereby incorporated by reference in its entirety.

FIELD OF THE DISCLOSURE

The present disclosure relates to a construction machine, such as a skid steer and compact loader, and in particular, to a linkage assembly for lifting a work implement of such construction machine.

BACKGROUND OF THE DISCLOSURE

Work machines, such as those in the agricultural, construction and forestry industries, perform a variety of operations. In some instances, the machines are provided with a work implement or tool to perform a desired function. The work implement or tool, such as a bucket, forklift, or grapple, is movably coupled to a frame of the machine by a mechanical lift arm or boom. The lift arm or boom is operably controlled by a machine operator using controls disposed in a cab of the machine.

In one instance, the machine may have a bucket operably coupled to a front end thereof. The operator of the machine can control the bucket to collect material at a ground level and transport the material to a desired location. The operator can operably control the bucket from the ground level to a maximum lift height such that a defined point of the bucket travels along a lift path. The shape of the lift path and the maximum lift height can be functions of the lift arm or boom and linkage assembly that couples the lift arm or boom to the frame. In many instances, the relationship of the linkage assembly and lift arm or boom defines the lift path and the maximum height achievable by the machine.

Conventional machines can be limited by the force generated by hydraulic actuators to move the work implement or tool to a maximum height. Moreover, many conventional machines may be designed to achieve a greater maximum height but with a limited breakout force at ground level (i.e., the force required to break or loosen a portion of material from a compact pile). Other conventional machines may possess greater breakout force potential but with reduced lift path heights.

A need therefore exists to provide a machine, and in particular, a linkage and boom assembly for the machine that can maximum breakout performance at ground level and also achieve greater lift heights.

SUMMARY

In an exemplary embodiment of the present disclosure, a work machine includes a frame and a ground engaging mechanism. The ground-engaging mechanism is adapted to support the frame. A work tool is coupled to the frame and is operably controlled to perform a desired function. The machine also includes a boom arm pivotally coupled to the work tool, where the boom arm is configured to move the work tool from a first position to a second position along a lift path. An upper link is pivotally coupled at one end to the frame and at an opposite end to the boom arm, where the upper link is pivotally coupled to the boom arm at a first location. A lower link is pivotally coupled at one end to the frame and at an opposite end to the boom arm, where the lower link is pivotally coupled to the boom arm at a second location. The machine further includes a hydraulic actuator pivotally coupled at one end to the frame and at an opposite end to the boom arm, where the hydraulic actuator is pivotally coupled to the boom arm at a third location. The first location and second location are spaced from one another by a first distance, the second location and third location are spaced from one another by a second distance, and the first location and third location are spaced from one another by a third distance. Here, the first distance and second distance are at least twice the third distance.

In a first aspect of this embodiment, the first distance and second distance are at least three times the third distance. In a second aspect, the boom arm includes an interior surface that defines a longitudinal axis such that the upper link, lower link, and hydraulic actuator are disposed offset from the longitudinal axis towards a centerline of the machine. In one form of this aspect, the upper link is offset from the longitudinal axis by a first offset distance and the hydraulic actuator is offset from the longitudinal axis by a second offset distance, where the first offset distance is greater than the second offset distance. In another form thereof, the lower link is offset from the longitudinal axis by a third offset distance, where the third offset distance is less than the first offset distance.

In another aspect, the upper link comprises a transverse bend defined therein between the one end and the opposite end thereof. Moreover, the upper link can include a rear coupling point defined between the one end and the opposite end such that the transverse bend is defined between the first location and the rear coupling point. In a different aspect, the work machine can include a second hydraulic actuator pivotally coupled at one end to the boom arm and a second end to the work tool, wherein the first and second hydraulic actuators each include a rod that extends between a retracted position and an extended position. Here, movement of each rod between the retracted position and extended position and corresponding pivotal movement of the upper link, lower link and first hydraulic actuator relative to the boom arm induces movement of the work tool along the lift path between the first position and the second position. Related thereto, the movement of the work tool along the lift path defines a lift curve relative to a hinge pin connection coupling the work tool and boom arm to one another such that the lift curve has at least a first region corresponding to the first position, a second region corresponding to the second position, and a third region corresponding to a position defined between the first position and second position. The lift curve can have a first defined slope in the first region, a second defined slope in the second region, and a third defined slope in the third region such that the first slope and second slope are greater than the third slope.

In another embodiment of this disclosure, a lift linkage assembly is provided for a work machine having a work tool. The lift linkage assembly includes a frame, a boom arm, an upper link, a lower link, and a hydraulic actuator. The boom arm is configured to be pivotally coupled to the work tool and has a surface that defines a longitudinal axis. The upper link has a first end pivotally coupled to the frame and a second end pivotally coupled to the boom arm. The lower link has a first end pivotally coupled to the frame and a second end pivotally coupled to the boom arm. The hydraulic actuator has a rod that is pivotally coupled to the boom arm and moves between a retracted position and an extended position. The hydraulic actuator is further coupled to the frame. The upper link, lower link, and hydraulic actuator are each spaced from the longitudinal axis.

In one aspect, the upper link is offset from the longitudinal axis by a first offset distance and the hydraulic actuator is offset from the longitudinal axis by a second offset distance, where the first offset distance is greater than the second offset distance. In another aspect, the lower link is offset from the longitudinal axis by a third offset distance, where the third offset distance is less than the first offset distance. In a different aspect, the upper link can include a transverse bend defined therein between the first end and the second end. Related thereto, the upper link can include a rear coupling point defined between the first end and the second end such that the transverse bend is defined between the second end and the rear coupling point. In a further aspect, the upper link is pivotally coupled to the boom arm at a first location, the lower link is pivotally coupled to the boom arm at a second location, and the rod is pivotally coupled to the boom arm at a third location. The first location and second location can be spaced from one another by a first distance, the second location and third location can be spaced from one another by a second distance, and the first location and third location can be spaced from one another by a third distance. Here, the first distance and second distance are each greater than the third distance.

In a different embodiment, a linkage assembly is provided for a work machine. The assembly includes a frame, a boom, a hydraulic actuator, a first link, and a second link. The hydraulic actuator has a rod that extends between a retracted position and an extended position, where the hydraulic actuator is pivotally coupled to the frame and the rod is pivotally coupled to the boom arm. The first link has a first end pivotally coupled to the frame and a second end pivotally coupled to the boom arm. The second link has a first end pivotally coupled to the frame and a second end pivotally coupled to the boom arm. The second link also includes a transverse bend defined therein between the first end and the second end.

In one aspect of the linkage assembly, the boom arm defines a longitudinal axis and the first link, second link, and hydraulic actuator are spaced from the longitudinal axis. Related to this aspect, the second link can be offset from the longitudinal axis by a first offset distance and the hydraulic actuator is offset from the longitudinal axis by a second offset distance, where the first offset distance is greater than the second offset distance. Moreover, the first link is offset from the longitudinal axis by a third offset distance, where the third offset distance is less than the first offset distance. In another aspect, the first link is pivotally coupled to the boom arm at a first location, the second link is pivotally coupled to the boom arm at a second location, and the rod is pivotally coupled to the boom arm at a third location. Here, the first location and second location are spaced from one another by a first distance, the first location and third location are spaced from one another by a second distance, and the second location and third location are spaced from one another by a third distance, where the first distance and second distance are each greater than the third distance.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
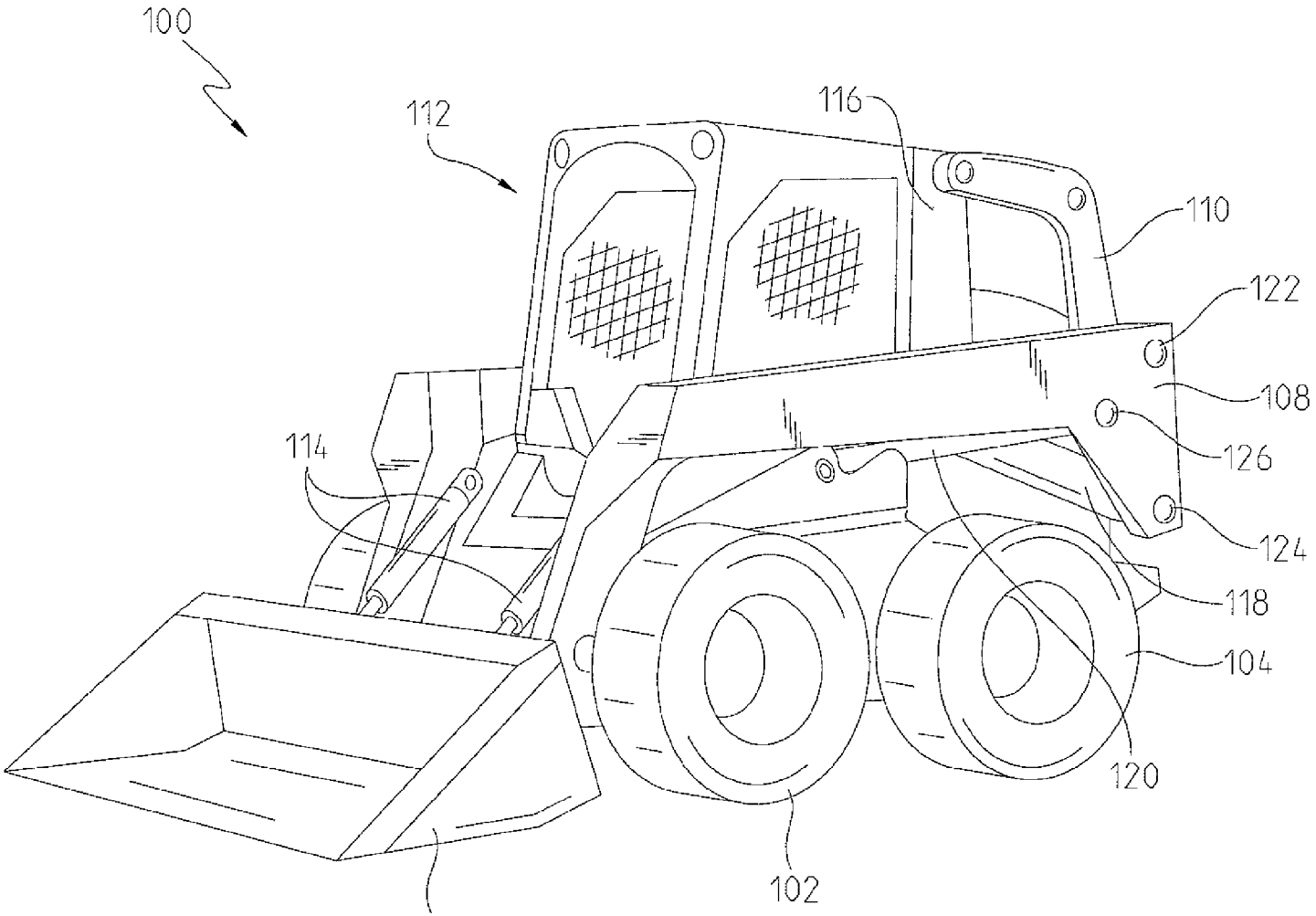
FIG. 1 is a side perspective view of a skid steer loader machine.

Referring to FIG. 1, an exemplary embodiment of a machine, such as a skid steer loader 100, is shown. This disclosure is not intended to be limited to a skid steer loader, however, but rather may include any agricultural, construction, or forestry machinery. The skid steer 100 can be provided with a ground-engaging mechanism for moving along the ground. In FIG. 1, the ground-engaging mechanism comprises a pair of front wheels 102 and a pair of rear wheels 104. In another aspect, such as a compact track loader, the ground-engaging mechanism can be a drive track disposed on each side of the machine. In a conventional skid steer, the operator can manipulate controls from inside a cab 112 to drive the wheels on the right or left side of the machine 100 at different speeds to thereby steer the machine 100 in a conventional manner.

The machine 100 can be further provided with a work implement or tool for performing a desired operation. In FIG. 1, the skid steer 100 includes a loader bucket 106 for collecting material therein and transporting said material to a desired location. The loader bucket 106 can be pivotally coupled to a forward portion of a pair of boom arms 108 positioned on each side of the machine 100. A pair of bucket tilt hydraulic actuators 114 can extend between the bucket 106 and the boom arms 108 for controlling the tilted orientation of the bucket 106 with respect to the boom arms 108. Each hydraulic actuator 114 can include a cylinder rod that actuates back and forth within a cylinder in response to a change in hydraulic pressure. By actuating the tilt hydraulic actuators 114, the operator can tilt the bucket 106 for dumping material therefrom.

In FIG. 1, the loader bucket 106 is shown at a minimum height. To raise the bucket 106, each of the pair of boom arms 108 is connected to an upper link 110 at a first location 122 and a lower link 118 at a second location 124. The upper link 110 and lower link 118 are also attached to a main frame 116 of the skid steer 100 at opposite ends of where each connects to the boom arm 108. A hydraulic actuator 120 is pivotally secured at one end to the main frame 116 and coupled to the boom arm 108 at an opposite end thereof. The hydraulic actuator 120 connects to the boom arm 108 at a third location 126. The first location 122, second location 124, and third location 126 are each approximately equidistantly spaced from one another.

Figure 2:
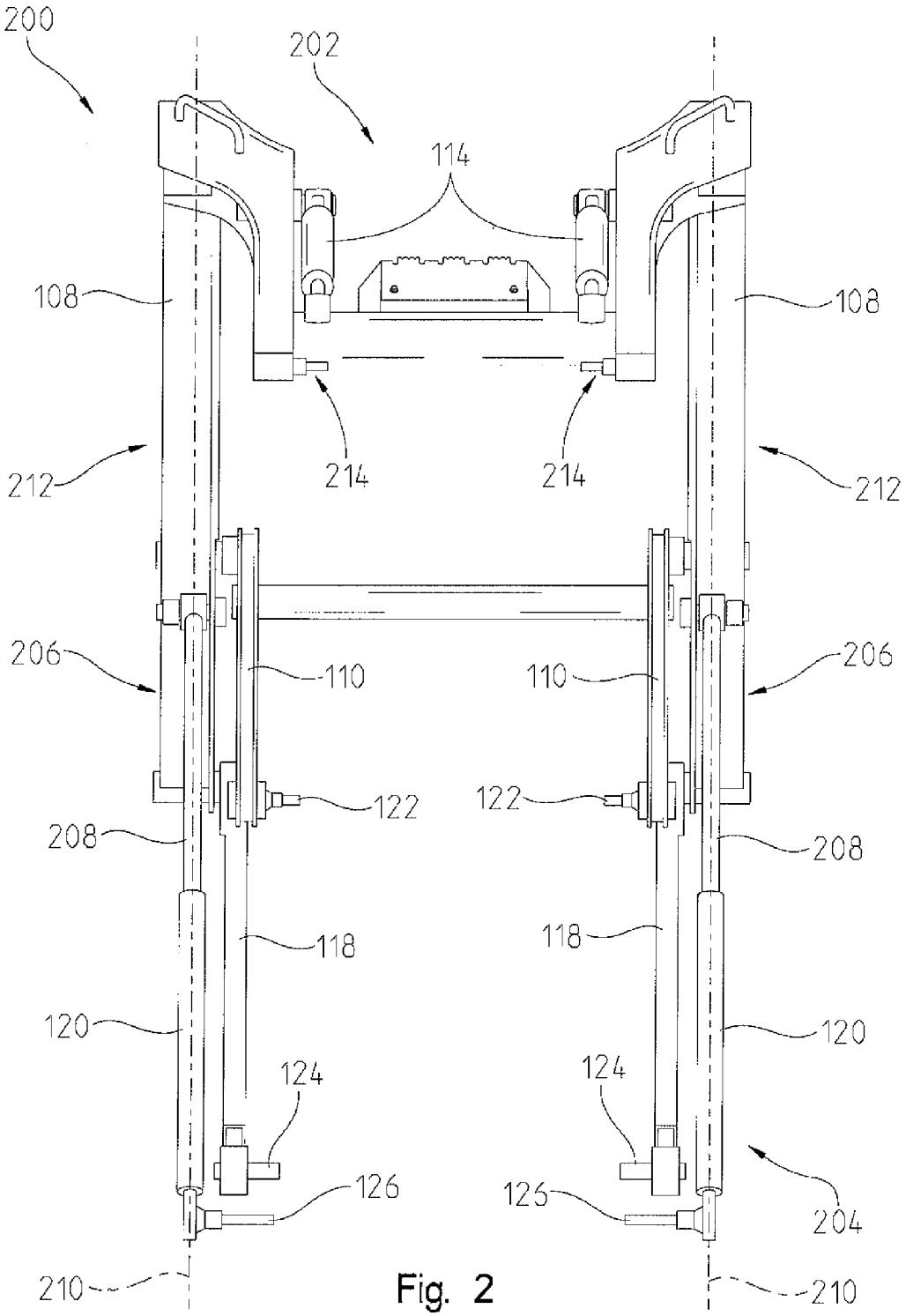
Fig. 2 (Prior Art)
FIG. 2 is a front view schematic of a conventional boom arm and linkage assembly for a work machine.

Referring to FIG. 2, a conventional arrangement of a lift linkage assembly 200 is shown. The assembly 200 includes a front end 202 and a rear end 204, where a work implement or tool (not shown) may be attached at the front end 202 of the machine. In particular, the work implement or tool may be hydraulically actuated by a pair of hydraulic actuators 214. The work implement or tool (not shown) may be attached to a chassis of the machine at a hinge pin location 214. The hinge pin location 214 is the location at which the work implement or tool is pivotally connected to the boom arm 108 of the machine. In FIG. 2, the linkage assembly 200 includes a pair of boom arms 108, one on each side of the machine.

On each side of the machine, the boom arm 108 is pivotally coupled to the upper link 110, lower link 118, and hydraulic actuator 120. In the conventional arrangement of FIG. 2, a longitudinal axis is identified by reference number 210. The axis 210 passes through each hydraulic actuator 120 and its corresponding rod 208. As shown, the axis 210 also passes through each boom arm 108, thereby showing the hydraulic actuator 120 and rod 208 being aligned with the boom arm 108. Moreover, the hydraulic actuator 120 is offset from the upper link 110 and lower link 118 in this arrangement.

To accommodate the hydraulic actuator 120 and rod 208, particularly as the hydraulic actuator 120 actuates between an extended position and a retracted position, each of the pair of boom arms 108 includes a first portion 212 and a second portion 206. The first portion 212 has a first thickness and the second portion 206 has a second thickness, where the second thickness is less than the first thickness. In other words, the boom arm 108 includes a recessed area that is defined by the second portion 206 thereof. The recessed portion 206 provides clearance for the actuator 120 to actuate to different positions. The hydraulic actuator 120 is connected to the boom arm 108 at the third connection point 126, which is defined in the recessed portion of the boom arm 108.

The conventional linkage assembly of FIG. 2 has a limited boom breakout force, or force generated at the bucket cutting edge. As defined above, the boom breakout force is the force exerted at ground level by the bucket or work tool to break or loosen material from a compacted pile of material. For instance, if a skid steer loader is collecting dirt from a compact dirt pile, the breakout force is the force at which the bucket exerts on the pile to break apart or loosen dirt therefrom. With many conventional skid steers, there is a trade-off between having a high breakout force and being able to lift a load to a greater lift height. In other words, for a conventional skid steer having a greater breakout force, the same steer has a limited lift height and vice versa.

In FIGS. 3-6, the present disclosure provides an exemplary embodiment of a lift linkage assembly 300. In FIGS. 3A and 3B, the linkage assembly 300 is shown disposed in a first position and a second position, respectively. The lift linkage assembly 300 can include a boom arm 304, an upper link 310, a lower link 312 and a hydraulic actuator 314. The hydraulic actuator 314 can include a cylinder rod that actuates back and forth within a cylinder in response to a change in hydraulic pressure. The boom arm 304 can be coupled to a work implement or tool at a hinge pivot location 306. One or more hydraulic actuators can also be coupled at one end 308 to a frame or chassis 302 and at an opposite end to the work implement or tool. The one or more hydraulic actuators can provide hydraulic power to move the work implement or tool. In particular, the one or more hydraulic actuators 308 pivot relative to the boom arm 304 such that the lift assembly 300 and hydraulic actuators 308 can lift the work implement or tool from a ground level to a maximum lift height along a lift path. This will be discussed in further detail with reference to FIG. 7.

Figure 3A:
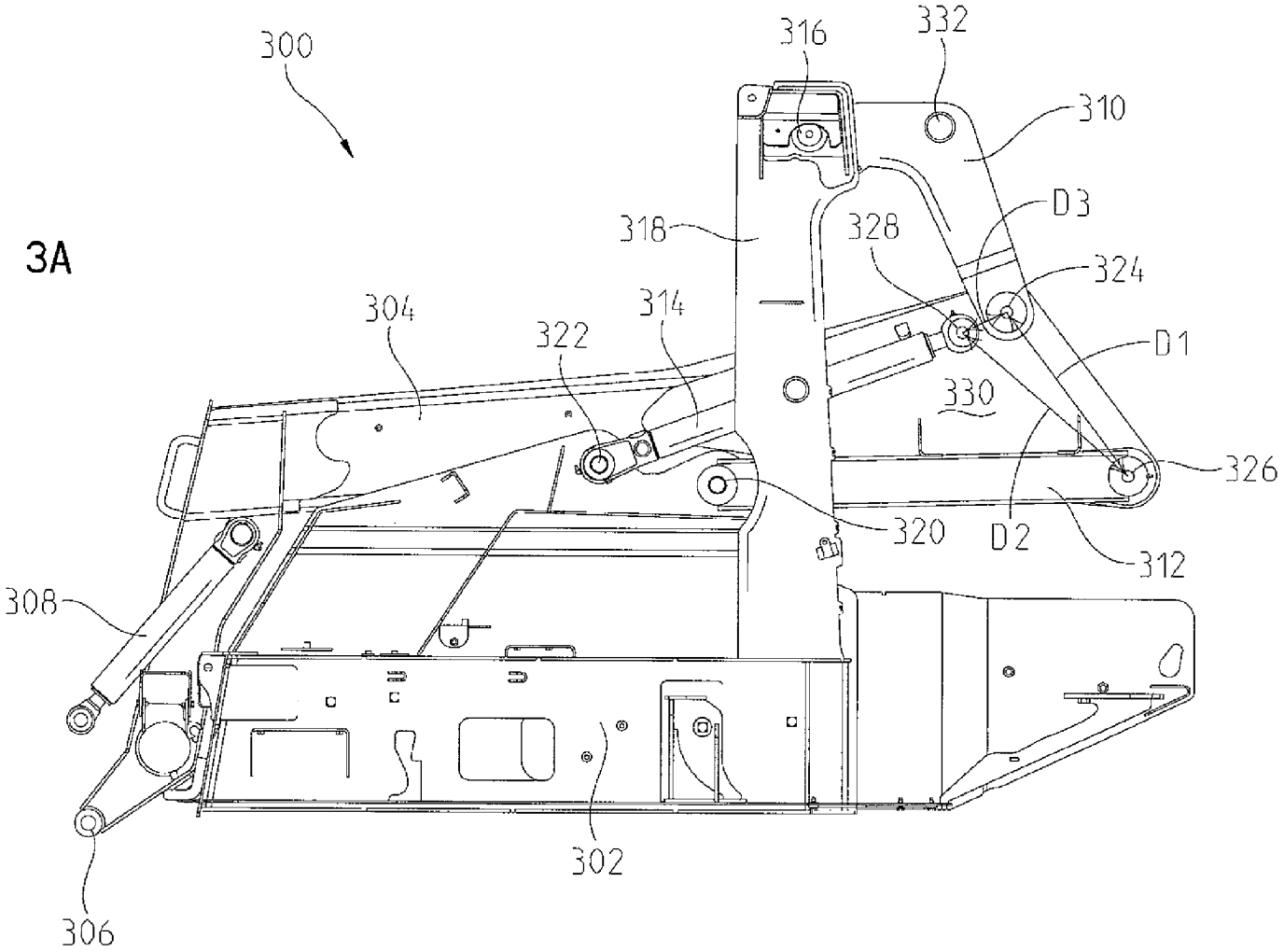
FIG. 3A is a side schematic view of an exemplary embodiment of a boom arm and linkage assembly in a first position.
Figure 3B:
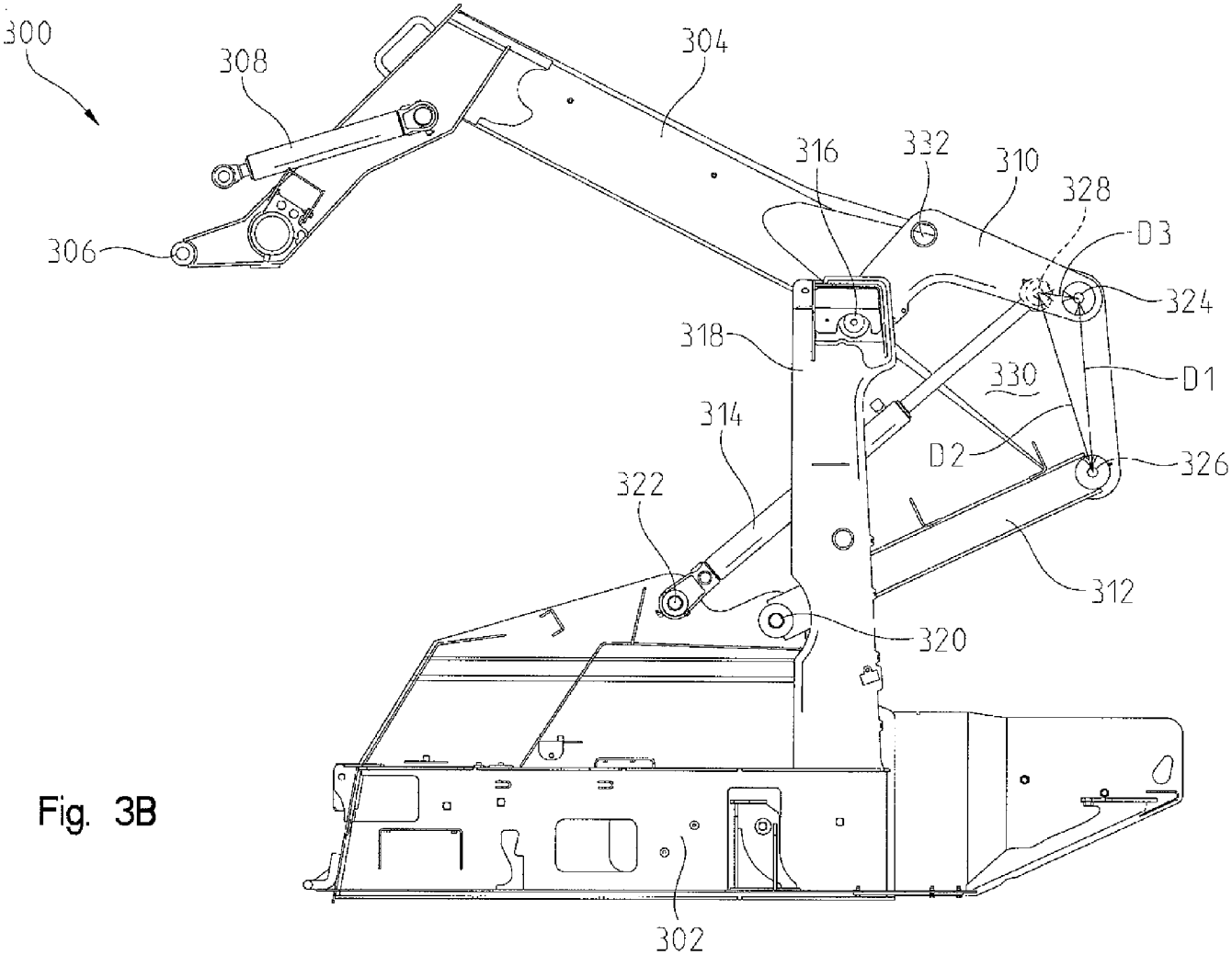
FIG. 3B is a side schematic view of the boom arm and linkage assembly of FIG. 3A in a second position.

The upper link 310 can be pivotally coupled to the boom arm 304 at a first connection point 324 and the lower link 312 can be pivotally coupled to the boom arm 304 at a second connection point 326. Similarly, the hydraulic actuator 314 can be pivotally coupled to the boom arm 304 at a third connection point 328. As shown in FIGS. 3A-B, the first connection point 324, the second connection point 326 and the third connection point 328 are each disposed inside an inner surface 330 of the boom arm 304. In other words, in FIGS. 3A-B, inner surface 300 is disposed towards the interior of the machine and each of the upper link 310, lower link 312, and hydraulic actuator 314 are pivotally coupled to the boom arm 304 at locations offset from or inside of the inner surface 330 of the boom arm 304. This is further shown in FIGS. 4 and 5 and is addressed below.

Moreover, the locations of the first connection point 324, second connection point 326, and third connection point 328 relative to one another is different than the conventional linkage assembly 200 of FIG. 2, i.e., the first connection point 324 is more closely disposed adjacent to the third connection point 328. More specifically, the first connection point 324 and second connection point 326 are spaced from one another by a first distance D1, and the second connection point 326 and third connection point 328 are separated from one another by a second distance D2. Likewise, the first connection point 324 and third connection point 328 are separated from one another by a third distance D3. In one aspect, the first distance and second distance can be approximately the same. In another aspect, the first distance and second distance may be different from one another, but both distances are greater than the third distance. In other words, the three distances are not the same and thus the connection points are not approximately equidistant from one another. In a different aspect, the first and second distance can be at least twice the third distance. In a further aspect, the first and second distances are three times or greater than the third distance.

Figure 4:
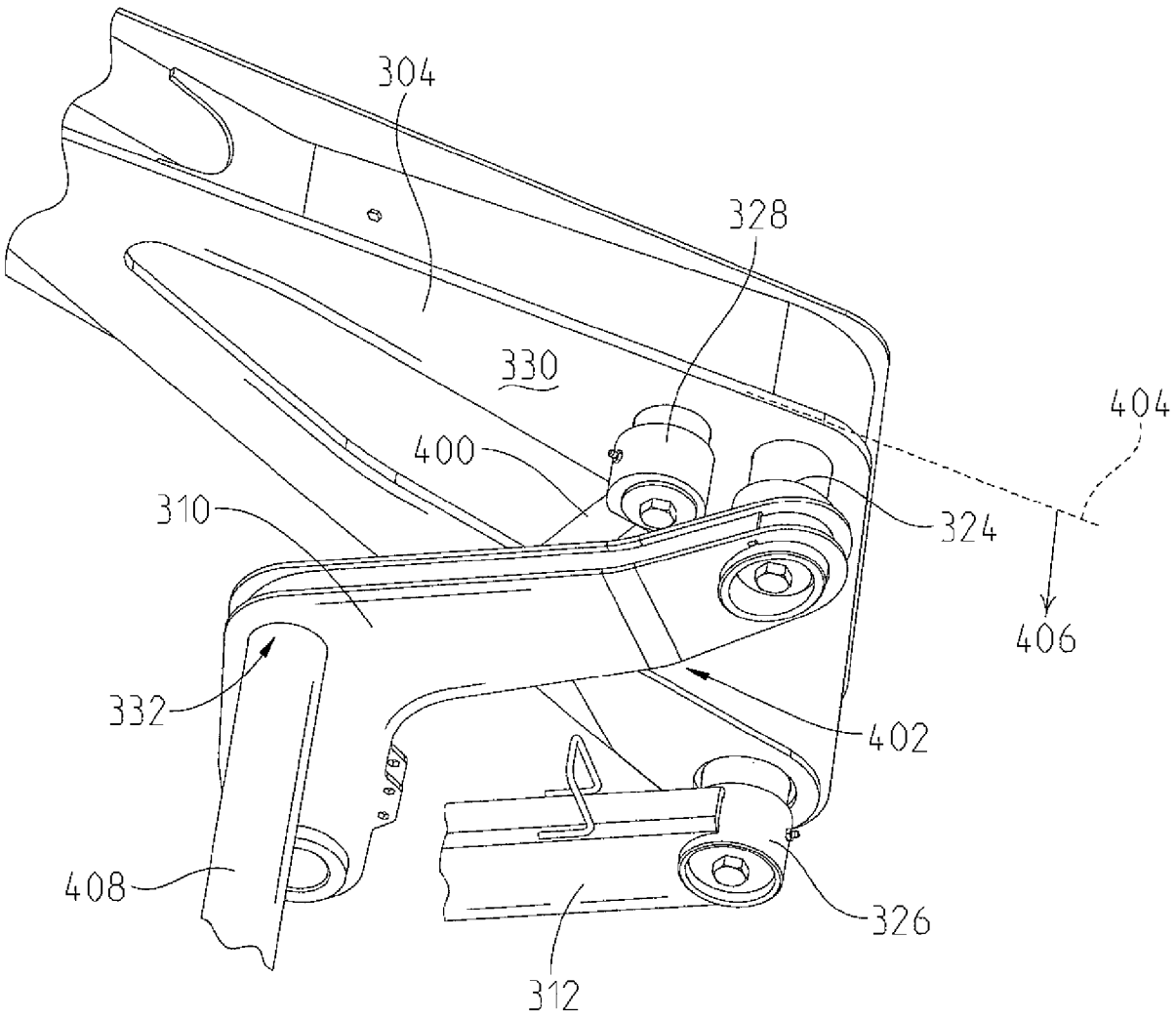
FIG. 4 is a partial perspective view of the boom arm and linkage assembly of FIGS. 3A-B.

Referring to FIGS. 3A-B, the upper link 310 is also coupled to the frame or chassis 302 of the machine. Here, the upper link 310 has a first end coupled to the frame or chassis 302 at a first pivot location 316 and a second end coupled at the first connection point 324. The first pivot location 316 is disposed along a rear tower portion 318 of the frame or chassis 302. The upper link 310 can have a substantially L-shaped structure where the pivot location 316 is at the first end, the first connection point 324 is at the second end, and a rear coupling point 332 disposed therebetween. In FIG. 4, for example, the rear coupling point 332 can be used for coupling the upper link 310 to a frame member 408 that extends between the upper link 310 on the leftside of the machine and the upper link 310 on the rightside of the machine. This allows the machine to operably lift and lower the work implement or tool in a controlling manner using a linkage assembly 300 on both sides of the machine.

The lower link 312 can also be pivotally coupled to the frame or chassis 302 of the machine at a second pivot location 320. Similarly, the hydraulic actuator 314 can be pivotally coupled to the frame or chassis 302 at a third pivot location 322. Therefore, the upper link 310, lower link 312, and hydraulic actuator 314 are pivotally coupled to the frame or chassis 302 of the machine and to the boom arm 304. As previously described, the machine can include a lift linkage assembly 300 on both sides thereof such that the machine includes at least two boom arms 304, upper links 310, lower links 312, and hydraulic actuators 314.

Figure 5:
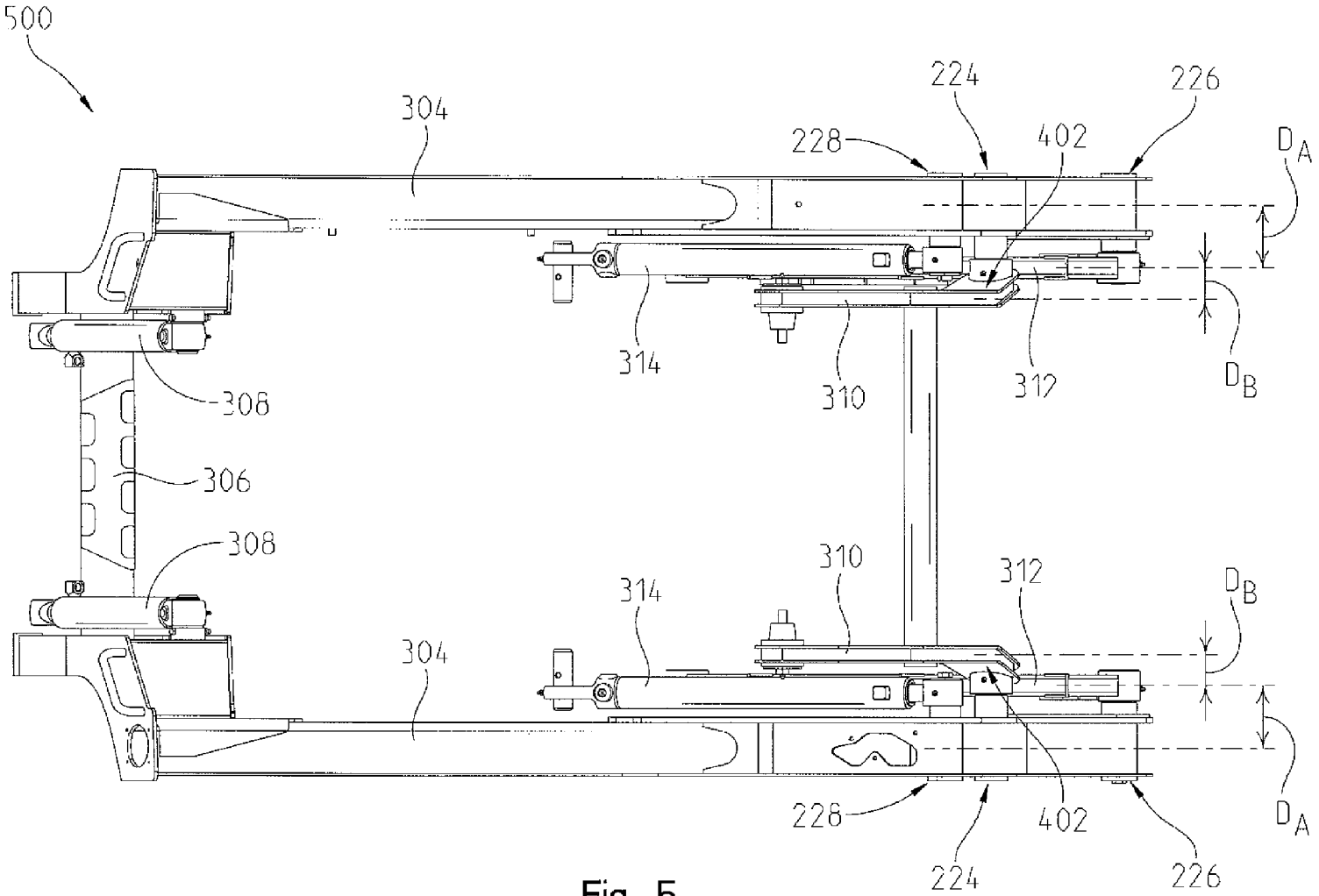
FIG. 5 is a top elevational view of the boom arm and linkage assembly of FIGS. 3A-B.

Referring now to FIGS. 4 and 5, the inner surface 330 of the boom arm 304 is defined as being planar along line 404. As shown, the upper link 310, lower link 312, and hydraulic actuator 314 are disposed offset from the line 404 in a direction indicated by arrow 406. Moreover, a rod 400 of the hydraulic actuator 314 is coupled to the boom arm 304 at the third connection point 328. In FIG. 5, the rod 400 and hydraulic actuator 314 can be offset from the boom arm 304 by a distance $D_A$. Similarly, the lower link 312 is coupled to the boom arm 304 at the second connection point 326 and can be offset from the boom arm 304 by approximately the same distance $D_A$. In other words, the hydraulic actuator 314 and lower link 312 can be offset towards the centerline of the machine (i.e., interior of the machine) by approximately the same distance, $D_A$. Due to the first connection point 324 and third connection point 328 being disposed in close proximity to one another, however, the upper link 310 can be offset from the boom arm 304 by a distance $D_B$. Here, distance $D_A$ is greater than $D_B$ such that pivotal movement of either the upper link 310 or hydraulic actuator 314 does not result in any interference between the two links. Moreover, as the boom arms 304 move the work implement or tool between a ground position and a maximum lift height position, the additional offset of the upper links 310 from the boom arms 304 allows the entire lift linkage assembly 300 to move and pivot relative to one another without any contact or interference between any two of the links.

As is further shown in FIGS. 4 and 5, the upper link 310, lower link 312, and hydraulic actuator 314 can be disposed substantially parallel to the plane defined by line 404, and therefore the upper link 310, lower link 312, and hydraulic actuator 314 can be disposed at least partially substantially parallel to the inner surface 330 of the boom arm 304. Moreover, in one aspect, the lower link 312 and hydraulic actuator 314 can be defined in a first plane, and the upper link 310 can be defined in a second plane that is offset from the first plane. Alternatively, the upper link 310 can be defined in a first plane, the lower link 312 can be defined in a second plane, and the hydraulic actuator 314 can be defined in a third plane, where the first plane, second plane, and third plane are substantially parallel to but offset from one another.

In FIGS. 4 and 5, besides the upper link 310 being offset from the boom arm 304 at a greater distance than the hydraulic actuator 314 and lower link 312, the upper link 310 can also include a transverse bend 402 defined therein. The transverse bend 402 can be defined between the first connection point 324 and the rear coupling point 332. In other words, the transverse bend 402 is defined in the upper link 310 at a location nearest the first connection point 324 rather than the first pivot location 316. In the exemplary linkage assembly 300, the upper link 310 is coupled to the boom arm 304 at a location adjacent to or more close to the location at which the hydraulic actuator rod 400 couples to the boom arm 304 (i.e., the relative proximity of the first connection point 324 to the third connection point 328). Due to the close proximity of both connection points, the transverse bend 402 allows the hydraulic actuator 314 to extend and retract without contacting the upper link 310. In most conventional linkage assemblies, the upper link and hydraulic actuator are spaced from one another at a distance such that potential interference between the linkages as the boom arm moves is not an issue. However, to achieve the desired lift curve and lift height of the exemplary lift linkage assembly 300, the first connection point 324 and third connection point 328 can be disposed in close proximity to one another due to the transverse bend 402 defined in the upper link 310.

Referring back to FIG. 2 of the conventional linkage assembly 200, the hydraulic actuator/actuator 120 is shown in an extended position where the actuator 120 and rod 208 were aligned with or overlapped a recessed portion 206 of the boom arm 108. The recessed portion of the boom arm 108 is a necessity in the conventional assembly 200 due to the positioning and location of the connection point 126 between the hydraulic actuator 120 and boom arm 108. This, however, reduced the maximum lift height and limited the amount of breakout force potential of the machine. In addition, the recessed portion of the boom arm 304 reduced the overall strength of the boom arm 108, thereby limiting the lift height, breakout force, and overall productivity of the machine.

Figure 6:
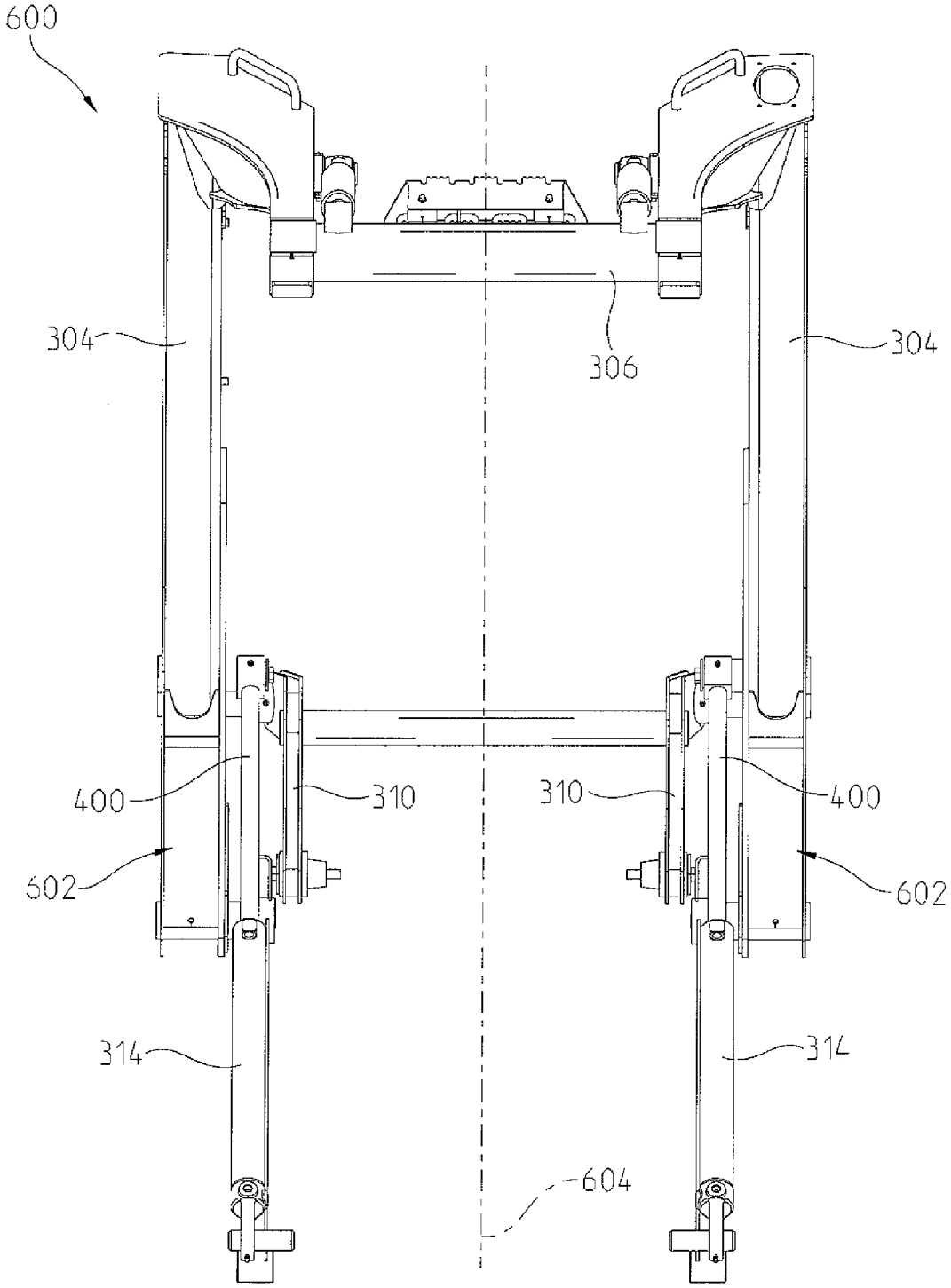
FIG. 6 is a front elevational schematic view of a hydraulic actuator of the boom arm and linkage assembly in an extended position.

In FIGS. 5 and 6, however, the positional relationship of the hydraulic actuator 314 relative to the boom arm 304 is shown for the exemplary linkage assembly 300. Here, each hydraulic actuator 314 is disposed offset towards the machine centerline 604 from the respective boom arm 304. In FIG. 6, for example, the linkage assembly 300 is in an extended position 600 whereas in FIG. 5 it is in a retracted position 500. As a result, the boom arm 304 can include a reinforced portion 602 that does not include a recessed area. The boom arm 304 provides greater strength, and the linkage assembly 300 as a whole can achieve greater breakout force and maximum lift height.

Another aspect of the positional relationship of the hydraulic actuator 314 relative to the boom arm 304 is the improved visibility for the machine operator. In the conventional linkage assembly of FIG. 2, as the linkage assembly 200 moved towards a maximum lift height position, the boom arm 108 and hydraulic actuator 120 were positioned at different horizontal planes relative to one another. In other words, the hydraulic actuator 120 is positioned substantially beneath the boom arm 108 on both sides of the machine such that the machine operator had limited or reduced vision outside both the left and right sides of the machine. As shown in FIGS. 3A-B, however, the third connection point 328 allows the hydraulic actuator 314 to be substantially aligned in a horizontal direction or plane with the boom arm 304. Thus, as the linkage assembly 300 moves toward a maximum lift height position, the area occupied by the boom arm 304 is also occupied by the hydraulic actuator 314, thereby allowing for improved visibility out both sides of the machine.

Figure 7:
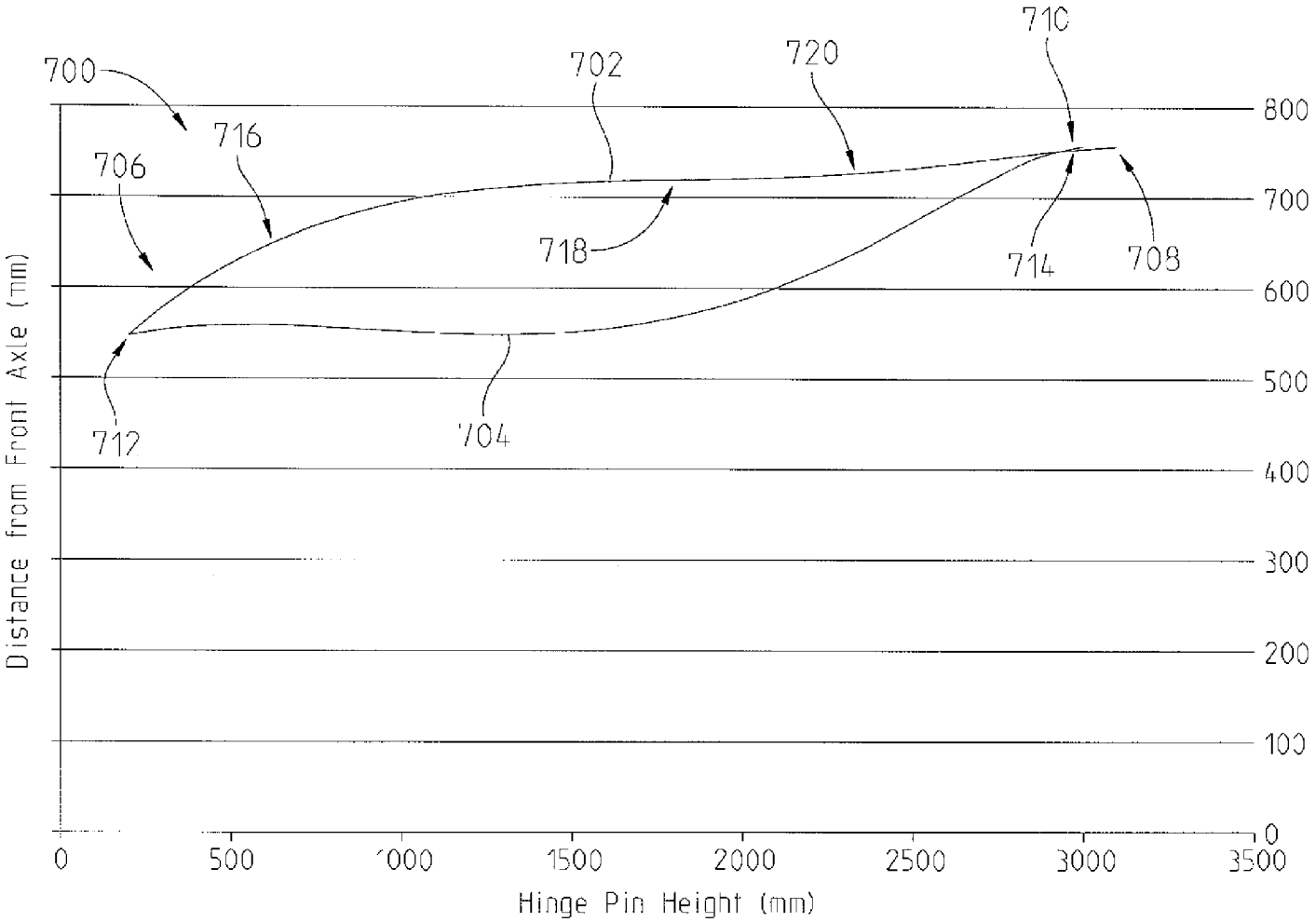
FIG. 7 is a graphical representation of hinge pin lift path for a work machine.

In addition to some of the advantages described above, the exemplary lift linkage assembly 300 can also provide for additional benefits to breakout force and lift height. Referring to FIG. 7, a non-limiting example of a lift curve having the exemplary linkage assembly 300 is shown in a graphical representation 700. In particular, a first lift curve 702 is shown for a 323E Series Compact Track Loader manufactured by Deere & Company. The first lift curve 702 is representative of a machine having the exemplary lift linkage assembly 300. A second lift curve 704 is provided for a machine having a more conventional lift linkage assembly.

In FIG. 7, the first and second curves both include a ground level height or position represented by a point 712 on the graphical representation 700. This height corresponds to the hinge pin height, where the hinge pin 306 is shown in FIGS. 3A-B. The first curve 702 is illustrative of the path followed by the hinge pin 306 from a ground level position (i.e., point 712) to its maximum lift height position (i.e., point 708). Moreover, the second curve 704 having the conventional lift linkage has a maximum lift height corresponding to point 714 on the graphical representation 700. As shown, the first curve 702 can reach a greater maximum lift height compared to the second curve 704 as the maximum lift height point 708 is offset to the right of lift height point 714.

In addition, the lift linkage assembly 300 provides for a lift curve 702 that achieves better "reach ability", i.e., distance between the rear axle and hinge pin 306. More specifically, the lift curve 702 can include three defined regions. In a first region 706, the lift curve 702 has a first slope 716 that is much greater than the slope of the second curve 704. This can allow the machine to achieve greater breakout force at or near ground level. The breakout force can be much greater for the first lift curve 702 due to the repositioning of the hydraulic actuator 314 relative to the boom arm 304. In particular, the repositioning or offset location of the hydraulic actuator 314 can achieve a greater moment arm or lever advantage on the work implement or tool throughout the entire lift path.

The first lift curve 702 moves from a first region of increasing slope to a second region 718 where the curve begins to level out and has a reduced increasing slope compared to the first slope 716. As the linkage assembly 300 moves towards a maximum lift height position 708, the first lift curve 702 moves into a third region 710 where the slope begins to increase more slightly. Thus, in the second region 718, the lift curve 702 includes a partial inflection point or point of less increasing slope compared to the first region 706 and second region 710. As a result, based on the embodiment of FIG. 7, the exemplary lift linkage assembly 300 can provide for better breakout force in the first region 706 and a higher maximum lift height 708 in the third region, while also achieving better "reach ability" qualities compared to the conventional linkage assembly depicted by the second curve 704.

Figure 8:
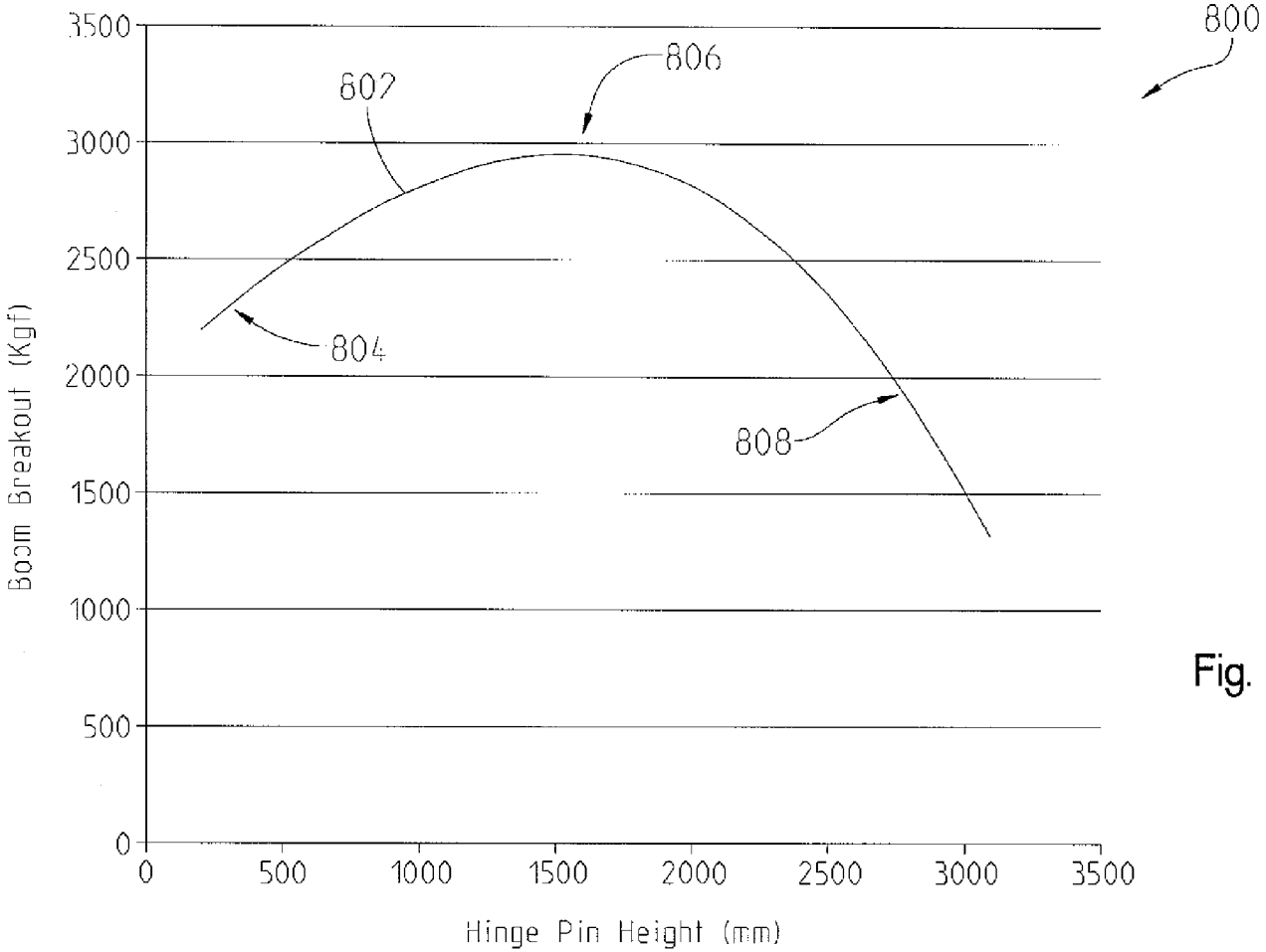
FIG. 8 is a graphical representation of boom breakout force relative to lift height of a work machine.

In FIG. 8, the boom breakout force of the exemplary lift linkage assembly 300 is further shown in a second graphical representation 800. Here, a curve 802 is shown for the 323E Series Compact Track Loader manufactured by Deere & Company. The curve 802 is substantially concave-shaped having a first portion 804 of increasing slope where breakout force is determined. In this first region 804, the curve 802 illustrates where the machine possesses a breakout force at roughly 2200 Kgf. The force reaches a maximum in a second region 806 before dropping off in a third region 808. By comparison, and in terms of English units, a conventional lift linkage assembly may achieve a breakout force of approximately 3700 lbs, whereas the exemplary lift linkage assembly 300 is able to achieve a breakout force of 4700 lbs. Here, the amount of force or hydraulic pressure from the hydraulic actuators remains the same, but the exemplary design of the linkage assembly 300 allows for greater breakout force near ground level, better maximum lift height, and higher "reach ability" over the conventional linkage assembly.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A lift linkage assembly for a work machine having a work tool, comprising:

a frame;

a centerline longitudinally defined along an interior of the work machine;

a boom arm configured to be pivotally coupled to the work tool, the boom arm defining an inner surface and a longitudinal axis and being configured to move the work tool from a first position to a second position along a lift path;

an upper link pivotally coupled at one end to the frame and at an opposite end to the boom arm, where the upper link is pivotally coupled to the boom arm at a first location;

a lower link pivotally coupled at one end to the frame and at an opposite end to the boom arm, where the lower link is pivotally coupled to the boom arm at a second location; and a hydraulic actuator pivotally coupled at one end to the frame and at an opposite end to the boom arm, where the hydraulic actuator is pivotally coupled to the boom arm at a third location;

wherein the upper link comprises a transverse bend away from the inner surface towards the centerline and defined between the first end and the second end;

wherein, the upper link, lower link, and hydraulic actuator are spaced from the longitudinal axis;

further wherein:

the first location and second location are spaced from one another by a first distance, the second location and third location are spaced from one another by a second distance, and the first location and third location are spaced from one another by a third distance;

the first distance is at least twice the third distance; and the second distance is at least twice the third distance.

2. The lift linkage assembly of claim 1, wherein the upper link is offset from the longitudinal axis by a first offset distance and the hydraulic actuator is offset from the longitudinal axis by a second offset distance, where the first offset distance is greater than the second offset distance.

3. The lift linkage assembly of claim 2, wherein the lower link is offset from the longitudinal axis by a third offset distance, where the third offset distance is less than the first offset distance.

4. The lift linkage assembly of claim 1, wherein:

the upper link comprises a rear coupling point defined between a first end of the upper link and a second end thereof; and the transverse bend is defined between the second end and the rear coupling point.

5. The lift linkage assembly of claim 1, wherein the first distance and second distance are at least three times the third distance.

6. The lift linkage assembly of claim 1, further comprising a second hydraulic actuator pivotally coupled at one end to the boom arm, wherein the first and second hydraulic actuators include a rod that extends between a retracted position and an extended position;

wherein, movement of each rod between the retracted position and extended position and pivotal movement of the upper link, lower link and first hydraulic actuator relative to the boom arm is adapted to induce movement of the work tool along the lift path between the first position and the second position.

7. The lift linkage assembly of claim 1, wherein the movement of the work tool along the lift path defines a lift curve relative to a hinge pin connection coupling the work tool and boom arm to one another, the lift curve having at least a first region corresponding to the first position, a second region corresponding to the second position, and a third region corresponding to a position defined between the first position and second position, where the lift curve has a first defined slope in the first region, a second defined slope in the second region, and a third defined slope in the third region such that the first slope and second slope are greater than the third slope.

8. A linkage assembly for a work machine, comprising:

a frame;

a centerline longitudinally defined along an interior of the work machine;

a work tool coupled to the frame, the work tool operably controlled to perform a work function;

a boom arm defining an inner surface pivotally coupled to the work tool and configured to move the work tool from a first position to a second position along a lift path;

a first link having a first end pivotally coupled to the frame and a second end pivotally coupled to the boom arm, the first link being pivotally coupled to the boom arm at a first location;

a second link having a first end pivotally coupled to the frame and a second end pivotally coupled to the boom arm, the second link being pivotally coupled to the boom arm at a second location, where the second link includes a transverse bend away from the inner surface toward the centerline and defined therein between the first end and the second end; and a hydraulic actuator having a rod that extends between a retracted position and an extended position, where the hydraulic actuator is pivotally coupled to the frame and the rod is pivotally coupled to the boom arm at a third location;

wherein, the first location and second location are spaced from one another by a first distance, the second location and third location are spaced from one another by a second distance, and the first location and third location are spaced from one another by a third distance;

wherein, the first distance is at least twice the third distance; and the second distance is at least twice the third distance;

wherein, the first link, second link, and hydraulic actuator are spaced from a longitudinal axis defined by the boom arm.

9. The linkage assembly of claim 8, wherein the second link is offset from the longitudinal axis towards the centerline by a first offset distance and the hydraulic actuator is offset from the longitudinal axis towards the centerline by a second offset distance, where the first offset distance is greater than the second offset distance.

10. The linkage assembly of claim 9, wherein the first link is offset from the longitudinal axis towards the centerline by a third offset distance, where the third offset distance is less than the first offset distance.

11. The linkage assembly of claim 8, wherein the first distance and second distance are at least three times the third distance.

12. The linkage assembly of claim 8, further comprising a second hydraulic actuator pivotally coupled at one end to the boom arm, wherein the second hydraulic actuator includes a rod that extends between a retracted position and an extended position;

wherein, movement of each rod of the first and second hydraulic actuators between the retracted position and extended position and pivotal movement of the first link, second link and first hydraulic actuator relative to the boom arm is adapted to induce movement of the work tool along the lift path between the first position and the second position.

13. The linkage assembly of claim 12, wherein the movement of the work tool along the lift path defines a lift curve relative to a hinge pin connection coupling the work tool and boom arm to one another, the lift curve having at least a first region corresponding to the first position, a second region corresponding to the second position, and a third region corresponding to a position defined between the first position and second position, where the lift curve has a first defined slope in the first region, a second defined slope in the second region, and a third defined slope in the third region such that the first slope and second slope are greater than the third slope.

14. The linkage assembly of claim 1, wherein the hydraulic actuator comprises a rod that extends between a retracted position and an extended position, where the rod is pivotally coupled to the boom arm at the third location.

15. The lift linkage assembly of claim 14, wherein the upper link comprises a transverse bend defined therein between the first end and the second end.

* * * * *